US006919786B2

(12) United States Patent
Krimmer et al.

(10) Patent No.: US 6,919,786 B2
(45) Date of Patent: Jul. 19, 2005

(54) ACTUATOR WITH MAGNETIC CIRCUIT HAVING TWO IRON PARTS

(75) Inventors: Erwin Krimmer, Pluederhausen (DE); Wolfgang Schulz, Bietigheim-Bissingen (DE); Christian Lorenz, Aalen-Unterrombach (DE); Matthias Brendle, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/258,919

(22) PCT Filed: Feb. 28, 2002

(86) PCT No.: PCT/DE02/00752

§ 371 (c)(1),
(2), (4) Date: Mar. 18, 2003

(87) PCT Pub. No.: WO02/071421

PCT Pub. Date: Sep. 12, 2002

(65) Prior Publication Data

US 2003/0155839 A1 Aug. 21, 2003

(30) Foreign Application Priority Data

Mar. 3, 2001 (DE) ..... 101 10 342

(51) Int. Cl.[7] ..... H01F 7/08
(52) U.S. Cl. ..... 335/229; 251/129.15; 335/220
(58) Field of Search ..... 335/220–230, 335/200–204; 251/129.15

(56) References Cited

U.S. PATENT DOCUMENTS 5,032,812 A * 7/1991 Banick et al. ..... 335/17
5,402,093 A 3/1995 Gibas
5,734,310 A * 3/1998 Ankney et al. ..... 335/228
6,175,291 B1 * 1/2001 Kleinert et al. ..... 335/251

FOREIGN PATENT DOCUMENTS

CH 396 551 A 7/1965

OTHER PUBLICATIONS

Takashi Kajima: Development of a High–Speed Solenoid Valve Investigation of the Energizing Circuits, IEEE Transactions on Industrial Electronics, IEEE Inc, New York, US, BD. 40, NR. 4, Aug. 1, 1993, pp. 428–435.

* cited by examiner

*Primary Examiner*—Elvin Enad
*Assistant Examiner*—Bernard Rojas
(74) *Attorney, Agent, or Firm*—Michael J. Striker

(57) ABSTRACT

An actuator (1) has two parts in the iron circuit and has a simple construction. A short-circuit element (3) has an offset (90), which depending on the position of an armature (9) varies the course (60) of magnetic flux in such a way that over the entire stroke, a constant, high magnetic force is achieved, and thus a shallow course of magnetic force in stroke is attained.

12 Claims, 5 Drawing Sheets

ACTUATOR WITH MAGNETIC CIRCUIT HAVING TWO IRON PARTS

BACKGROUND OF THE INVENTION

Electrical actuators for valves or relays have at least three iron parts in a magnetic circuit, that is, a magnet armature and a two-part magnetic short-circuit element, which comprises a magnet pot and a magnet core.

In conventional magnets, the possibility of being better able to utilize the work capacity of the magnet by adapting the characteristic curve of the magnet to the required force-travel course of the respective valve or relay requires complicated geometries for the armature and its armature counterpart as well as stringent demands in terms of precision and tolerances.

SUMMARY OF THE INVENTION

The actuator of the invention has the advantage over the prior art that in a simple way, an actuator can be produced which comprises only two iron parts in the magnetic circuit, and which achieves a constant high magnetic force even over a wide travel course. The force-travel course of two different types of magnet are utilized here.

Furthermore, the actuator has a simple, economical construction, which is advantageous particularly in terms of the number of components as well as of the requisite production precision and machining processes.

To keep the magnetic resistance between a short-circuit element and a first end of an armature as slight as possible, it is advantageous that the short-circuit element has a sufficiently large proportional radial face.

It is advantageous if a sleeve is disposed in a coil. The sleeve press-fitted in the coil combines the securing and centering of a coil in the short-circuit element, and with high precision it limits a radial spacing between the armature and the magnetic short-circuit element, as a result of which the magnetic forces in the radial direction are effectively limited over the entire armature stroke. It also serves to provide magnetic insulation. A drawn sleeve makes a high surface quality possible, along with good sliding properties and high strength, at low production costs.

It is advantageous to produce the short-circuit element as a stamped and bent part, because this is a simple, economical production method for the short-circuit element.

The armature is advantageously a hollow cylinder, which is advantageously produced as a stamped and bent part. To achieve an outside diameter of the armature that is definitive for support, it is advantageous if beads are impressed on the outer jacket face of the armature and are calibratable by cold shaping, to achieve a certain geometry and tolerance.

The actuator can advantageously be used for a valve if a sealing plug that seals off one opening each in a three-way conduit is disposed in the armature.

BRIEF DESCRIPTION OF THE DRAWINGS

One exemplary embodiment of the invention is shown in simplified form in the drawing and explained in further detail in the ensuing description.

Shown are.

DETAILED DESCRIPTION OF THE PREFERRED EMBODIMENTS

Figure 1:
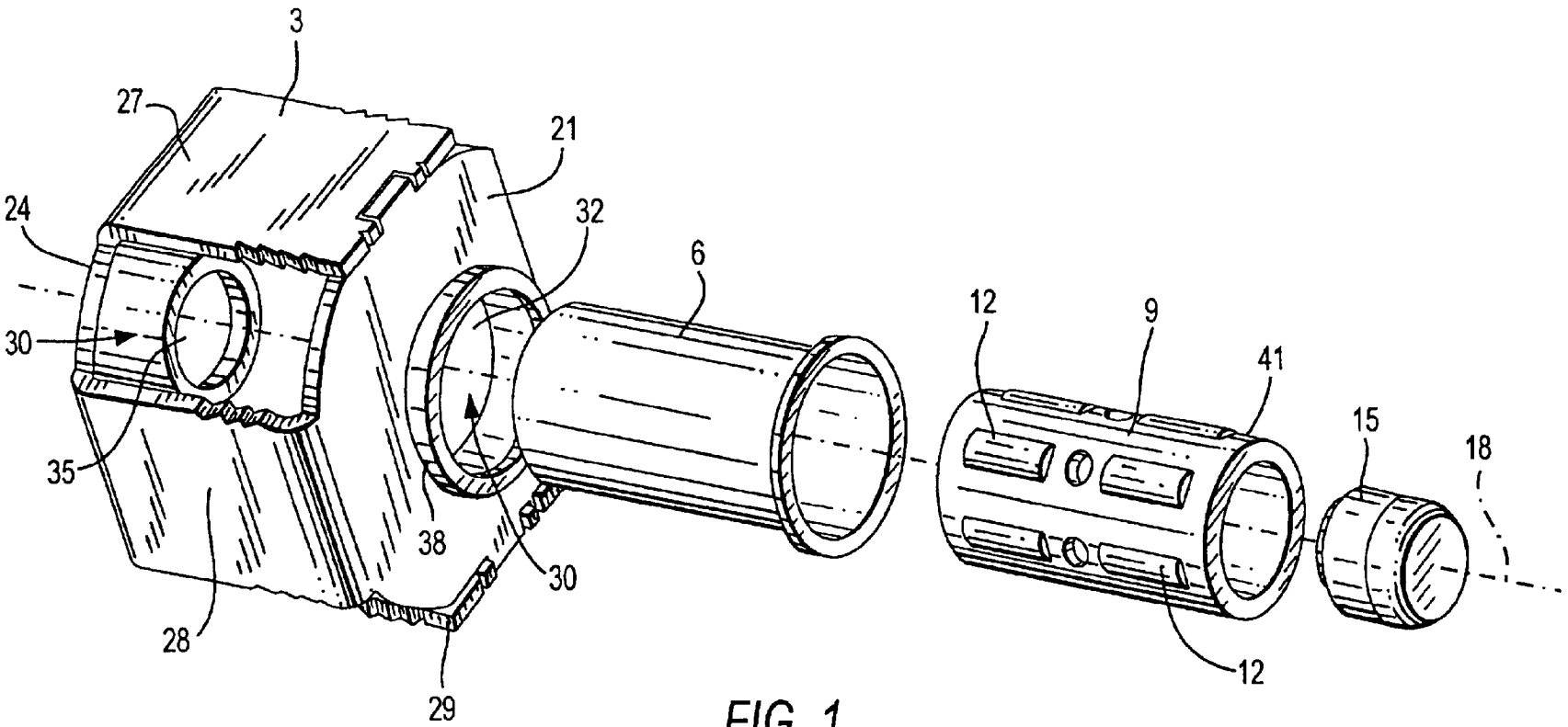
FIG. 1, a magnetic short-circuit element, a sleeve, an armature, and a sealing plug, as parts of an actuator of the invention.

FIG. 1 shows parts of an actuator 1 (FIGS. 3*a*, 3*b*) of the invention. The actuator 1 comprises at least one magnetic short-circuit element 3, which is produced for instance as a stamped and bent part and is for instance in a single piece.

The short-circuit element 3 has a first surface 21 and a second surface 24, which are disposed parallel to one another and extend perpendicular to an axial direction 18. The short-circuit element 3 also has for instance a first, second and third side face 27, 28, 29, which join the first and second surfaces 21, 24. Between each of the side faces 27, 28, 29 is a respective gap 30.

The first surface 21 has an indentation 38, for instance, which extends outward annularly in the axial direction 18. A sleeve 6, which for example is embodied hollow-cylindrically, and is for instance open on both axial ends, can be introduced into the short-circuit element 3 through a first opening 32 on the first surface 21 and through a second opening 35 on the second surface 24.

An armature 9 is disposed, in the assembled state of the actuator 1 (FIG. 3*a*), in the sleeve 6 and is displaceable in this sleeve 6 in the axial direction 18 between two terminal points. The armature 9 is a hollow cylinder, for instance, and is produced as a stamped and bent part, for instance. Often for the armature 9, an outer diameter must also be adapted, to make it readily displaceable in the sleeve 6. The armature 9 therefore, for instance on an outer jacket face 41, has beads 12 impressed outward, which can be calibrated by material-removing or reshaping processes, to produce a certain outer diameter.

A sealing plug 15 can be secured in the hollow-cylindrical armature 9.

Figure 2:
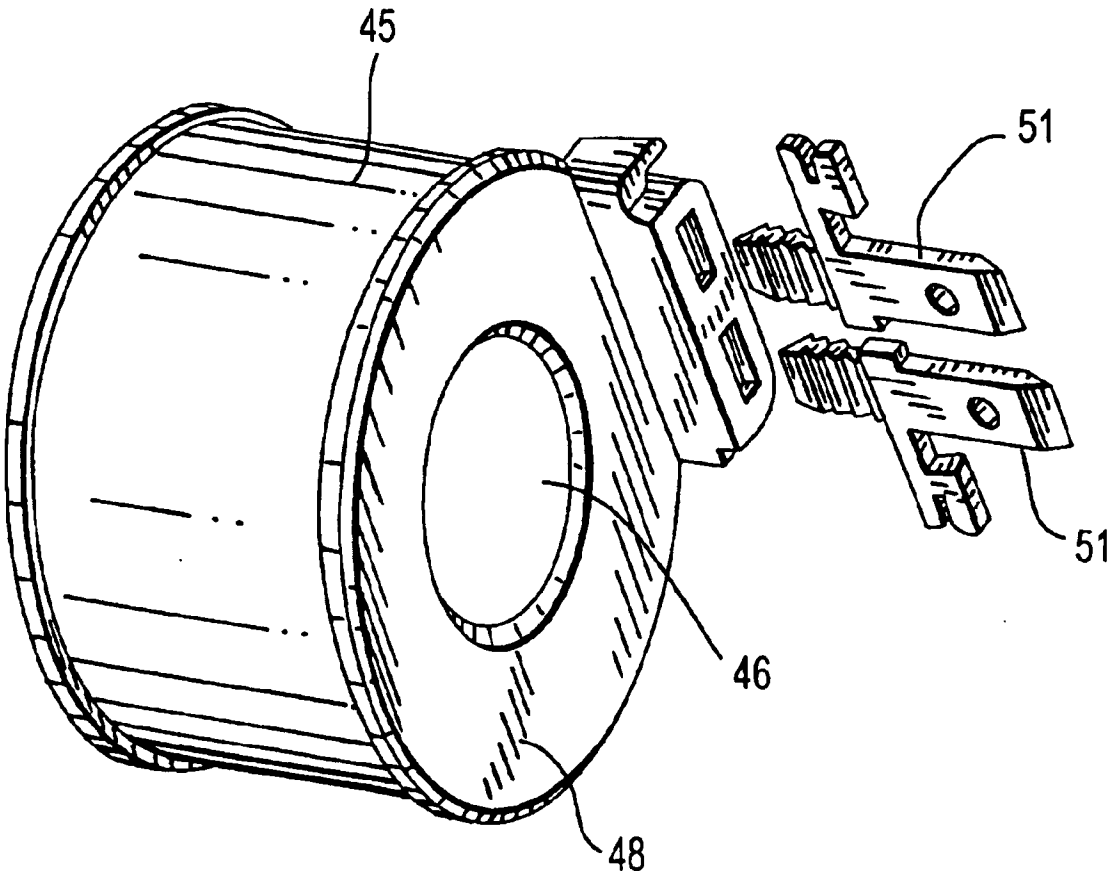
FIG. 2, a coil on a coil body.

FIG. 2 shows a coil 45, which is wound onto a coil body 48. Also disposed on the coil body 48 are electrical terminals 51, through which the coil 45 is supplied from outside with electrical current. The coil 45 is introduced for instance laterally through the gap 30 between the first side face 27 and the third side face 29 into the short-circuit element 3 of FIG. 1, whereupon a coil opening 46 is aligned with the openings 32 and 35 in the short-circuit element 3 (FIG. 3*a*).

Figure 3A:
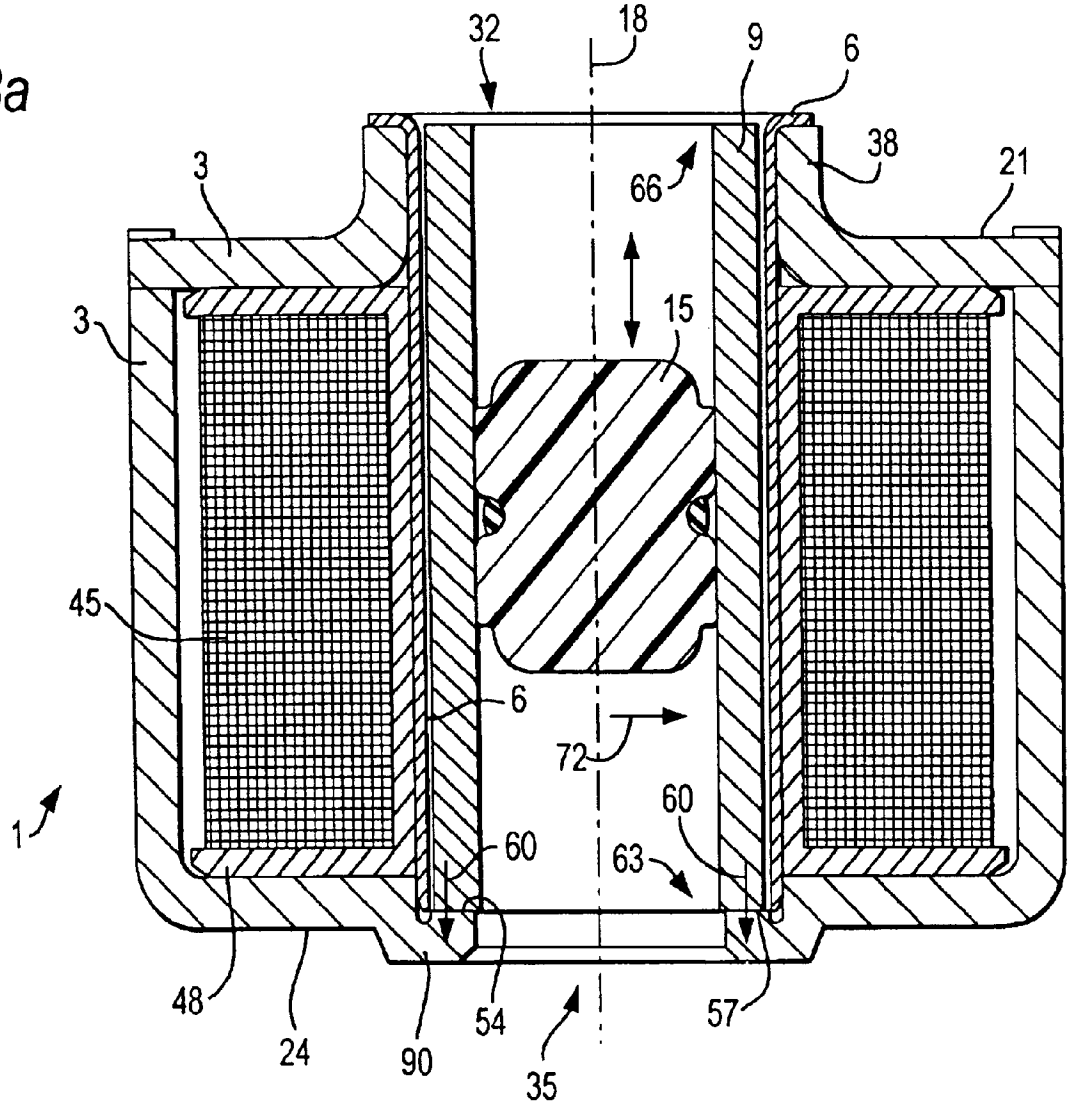
FIG. 3*a*, an axial cross section through an actuator of the invention, at a first terminal point.

FIG. 3*a* shows an actuator 1 of the invention in axial cross section, with its armature 9 in a first terminal position. The sleeve 6 is located tightly against the short-circuit element 3 and the coil 45, or coil body 48. In this position, the coil 45 is supplied with current, so that a spring (not shown) of a valve that engages the armature 9 is tensed.

The indentation 38 is formed on a second end 66 of the short-circuit element 3 and forms a large enough radial face that a magnetic resistance between the radial face of the short-circuit element 3 and the armature 9 is slight. The force-travel (stroke) curve of the armature 9 is therefore determined predominantly by a first end 63 of the short-circuit element 3, located at the second surface 24.

The armature 9 is disposed entirely in the sleeve 6 and rests on a stop face 54 of the short-circuit element 3, which face extends in a radial direction 72 past the sleeve 6; that is, the opening 35 in the second surface 24 has a smaller inside diameter than the opening 32 in the first surface 21. The stop face 54 extends perpendicular to the axial direction 18.

In this first terminal position, the magnetic flux extends for the most part on the first end 63 through an end face 57 of the armature 9 and stop face 54, since this is the shortest distance to the short-circuit element 3. The distance to the short-circuit element 3 in the radial direction 72 is greater because of the sleeve. The course of magnetic flux is represented by arrows 60.

In this position, the typical hyperbolic stroke-force course via the armature stroke for truncated armature magnets is obtained. This assures strong holding forces and assures the doubling, which is required in switchover valves, of the magnetic force in the terminal position of the armature when the electric current is being supplied.

Figure 3B:
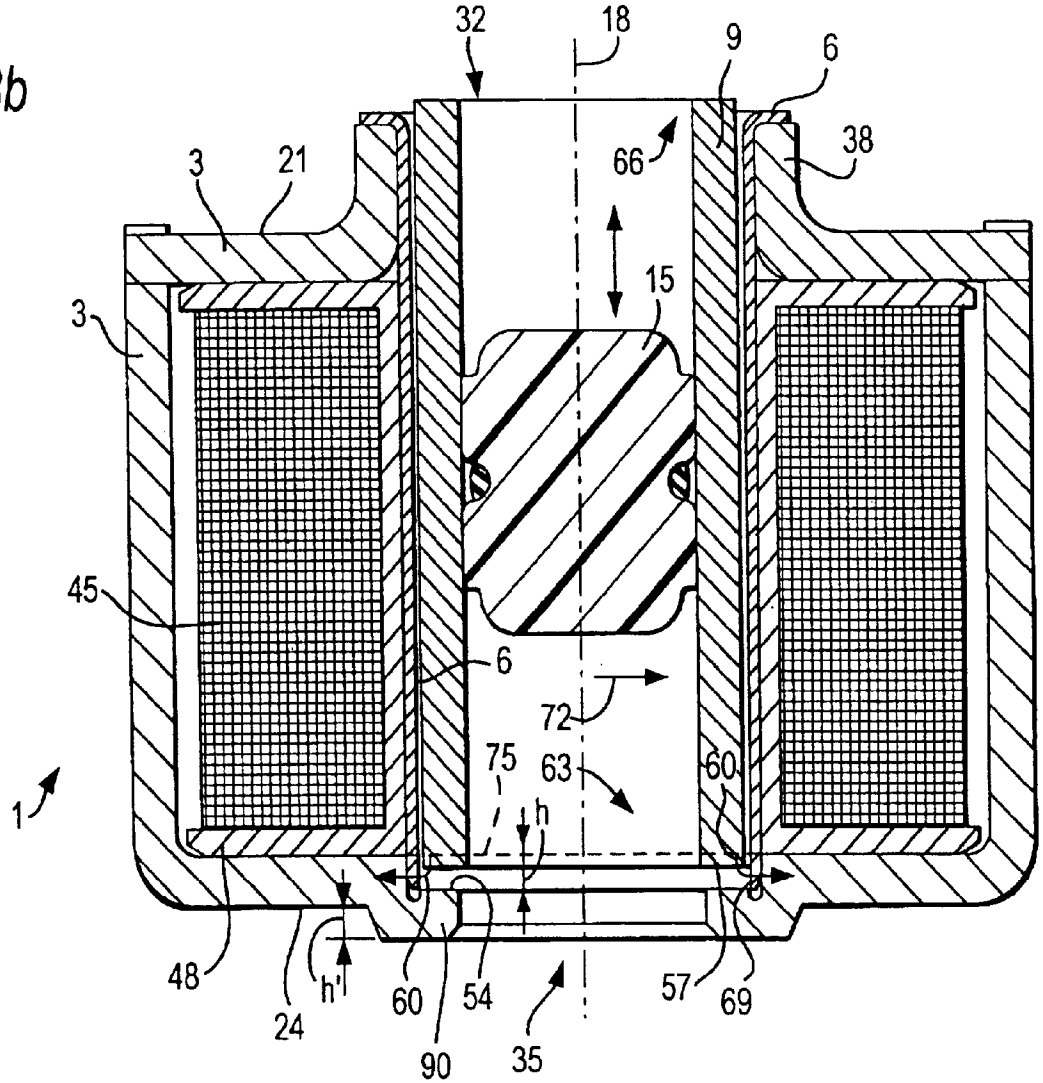
FIG. 3*b*, an actuator of the invention at a second terminal point.

FIG. 3*b* shows the armature 9 in a second terminal position. Here the magnetic force is less than the spring restoring force, and the armature 9 is displaced by a stroke, in comparison to the position of FIG. 3*a*, and for instance protrudes from the sleeve 6 on the end 66. This is due to the fact for instance that a spring (not shown) of a valve engages the armature 9 and in this position is more relaxed than in the first terminal position of FIG. 3*a*. The sleeve 6 can also be embodied such that the armature 9 is disposed entirely in the sleeve 6, despite any motion. The course of magnetic flux 60 on the first end 63 of the short-circuit element 3 differs, however, in this position from that of FIG. 3*a*. The course of magnetic flux 60 begins at the end face 57 of the armature 9 and then instead extends over a radial proportional face 69 of the magnetic short-circuit element 3, since this course has the least magnetic resistance. The course of magnetic flux 60 is curved here. This course of magnetic flux is equivalent to that of a proportional magnet and leads to the characteristic force-stroke course of such a magnet. The magnetic flux gradient has an especially pronounced axial component in this case.

Because of this behavior of the course of magnetic flux 60 in both terminal positions, high armature attraction forces are possible over the entire stroke range. An actuator with either a proportional magnet or a truncated armature of the prior art does not perform enough work in a terminal position.

An actuator of the prior art has an end face 75, shown here in dashed lines. The end face 75 is located at approximately the same axial level 18 as one end of the coil 45 or of the coil body 46, in the region of its second terminal position.

The actuator 1 of the invention, on the short-circuit element 3, has an offset 90, of height h', for instance, which protrudes past the second surface 24.

A distance between the end face 75 and the stop face 54 of the short-circuit element 3 in the axial direction 18 is approximately equivalent to the maximum stroke h of the armature 9. The height h' is approximately equivalent to the spacing h but can also be less or greater.

This spacing h is what first creates the radial face 69, which makes the proportional behavior of the armature in one position possible. Thus over the entire stroke, a constantly high magnetic force is achieved, and a shallow course of the magnetic force and travel is attained.

Figure 4:
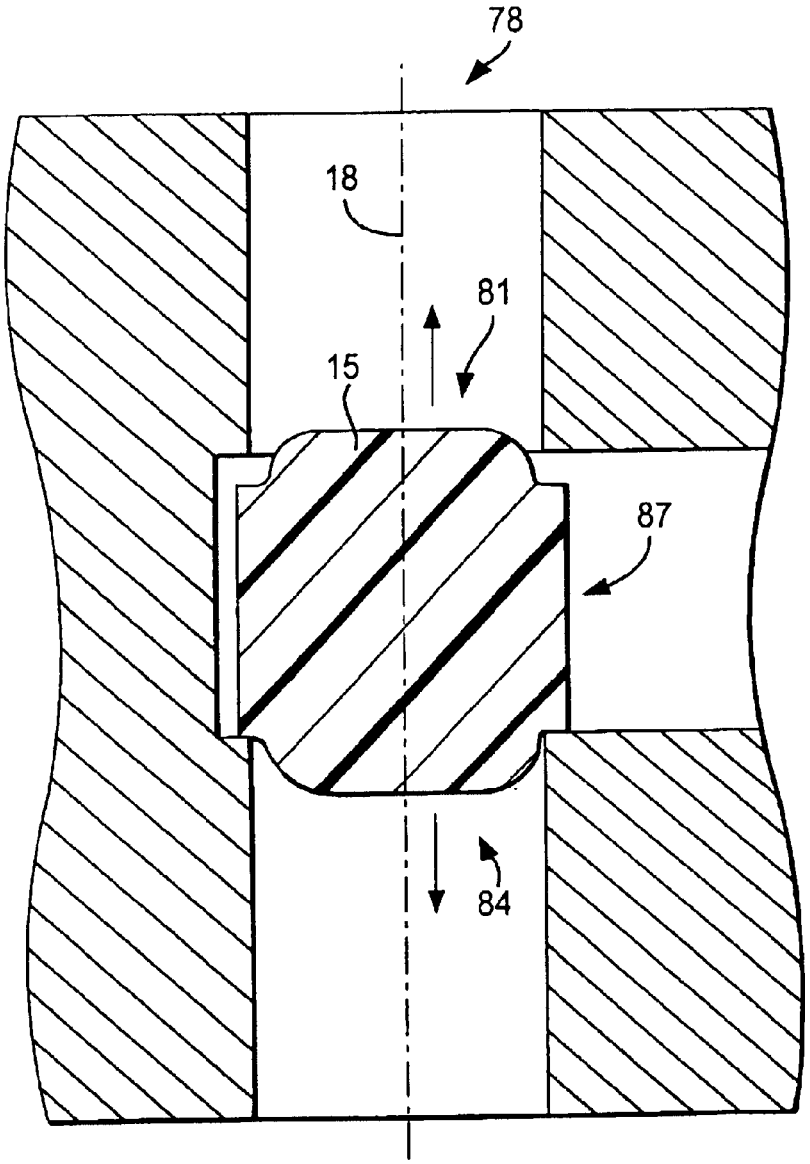
FIG. 4, the use of the actuator of the invention in a valve.

FIG. 4 shows an example of use of the actuator 1 of the invention as a 3/2-way valve. The sealing plug 15 of the actuator 1 of the invention is disposed for instance in a triple-connection conduit 78, with a first, second and third conduit opening 81, 84, 87. The sealing plug 15 can be moved back and forth in the axial direction 18 and selectively closes the first conduit opening 81 or the second conduit opening 84, so that either a communication between the conduit opening 81 and the conduit opening 87, or a communication between the second conduit opening 84 and the third conduit opening 87, is established.

What is claimed is:

1. An actuator, in particular for a valve or a relay, comprising at least:

an electrical coil, a magnetic short-circuit element for the coil, and an armature which is disposed at least partly in the coil, wherein the armature (9) is movable in an axial direction (18) between two terminal positions;

the course of magnetic flux in a first terminal position extends from the armature (9) primarily through a face on a first end (63) of the short-circuit element (3), to which the axial direction (18) is perpendicular;

the course of magnetic flux in a second terminal position of the armature (9) extends primarily through a face on the first end (63) of the short-circuit element (3) that extends parallel to the axial direction (18);

wherein the short-circuit element (3) is a stamped and bent part having a first surface (21) and a second surface (24) and further a first, a second, and third side face (27, 28, 29); and said first surface (21) and said second surface (24) are disposed parallel to one another and extend perpendicular to the first, the second, and the third side face (27, 28, 29), which extend in the axial direction (18) and join the first and second surfaces (21, 24).

2. The actuator of claim 1, wherein the armature (9) has an end face (57); and the short-circuit element (3), on a first end (63), has a large enough proportional radial face, at which the end face (57) is aimed, that a magnetic resistance between the proportional radial face (69) and the end face (57) is as slight as possible.

3. The actuator of claim 1, wherein the short-circuit element (3) has an indentation (38) on a second end (66).

4. The actuator of claim 1, wherein a sleeve (6) is disposed in the coil (45).

5. The actuator of claim 1, wherein the short-circuit element (3) is a stamped and bent part.

6. The actuator of claim 1, wherein the armature (9) is a hollow cylinder.

7. The actuator of claim 1, wherein the armature (9) is a stamped and bent part.

8. The actuator of claim 1 or 7, wherein the armature (9) has beads (12) on the outer jacket face (41).

9. The actuator of claim 1, wherein a sealing plug (15) is disposed in the armature (9).

10. The actuator of claim 9, wherein a triple-connection conduit (78) with three openings (81, 84, 87) is disposed in the actuator (1); and the sealing plug (15), in each terminal position of the armature (9), seals off one opening (81, 84) of the triple- connection conduit (78).

11. The actuator of claim 1, wherein the short-circuit element (3) has a stop face (54) for the armature (9) in the axial direction.

12. The actuator of claim 11, wherein the armature (9) and the short-circuit element (3) partly oppose one another in the radial direction (18), when the armature (9) is resting on the stop face (54).

* * * * *